United States Patent [19]

Bricker, Jr. et al.

[11] 4,451,099

[45] May 29, 1984

[54] ELECTRICAL CONNECTOR HAVING COMMONING MEMBER

[75] Inventors: Harry C. Bricker, Jr., Elizabethtown; David H. Gutter, Harrisburg; Robert S. Stull, Mechanicsburg, all of Pa.

[73] Assignee: AMP Incorporated, Harrisburg, Pa.

[21] Appl. No.: 376,077

[22] Filed: May 7, 1982

[51] Int. Cl.[3] ..... H01R 4/66

[52] U.S. Cl. ..... 339/14 R; 339/103 M; 339/176 MF

[58] Field of Search ..... 339/14 R, 17 F, 14 L, 339/97 P, 176 MF, 276 R, 276 D, 276 S, 103 R, 103 M, 107

[56] References Cited

U.S. PATENT DOCUMENTS 4,094,564 6/1978 Cacolici ..... 339/14 L
4,352,531 10/1982 Gutter ..... 339/14 R

OTHER PUBLICATIONS

*IBM Technical Disclosure Bulletin,* vol. 8, No. 10, Mar. 1966, J. M. Cioffi et al, "Wire Barrel Connector," p. 1328.

*Primary Examiner*—Eugene F. Desmond
*Assistant Examiner*—Steven C. Bishop
*Attorney, Agent, or Firm*—Adrian J. LaRue

[57] ABSTRACT

An electrical connector comprises a dielectric housing having rows of terminal passageways. First electrical terminals are respectively disposed in the passageways of one of the rows of terminal passageways for electrical termination with respective signal conductors of a flat cable. Second electrical terminals are respectively disposed in the passageways of another of the rows of terminal passageways and include electrical connection sections. A commoning connector member is adapted to be crimped onto the ground conductors of the flat cable, the crimped commoning connector member being connectable with the electrical connection sections.

10 Claims, 4 Drawing Figures

14
14
10
10
12
24
40
40
38
50
46
48
44
46
52
48
20
C
44
46
21
20
21
22
54
30
32
30
28
52
54
16
22
26
50

ELECTRICAL CONNECTOR HAVING COMMONING MEMBER

FIELD OF THE INVENTION

This invention relates to electrical connectors and more particularly to electrical connectors having a commoning member for commoning the drain wires of a ribbon coax cable or the ground conductors of a flat transmission cable.

BACKGROUND OF THE INVENTION

The connector in U.S. Pat. No. 4,094,566 and connectors similar thereto disclose a connector housing having rows of electrical terminals with one row terminating signal conductors and the other row terminating ground conductors. The row of ground terminals also includes a row of additional ground terminals in the form of a bus in which the ground conductors are also terminated thereby commoning all of the ground conductors on one side of the connector housing while the signal conductors are individually terminated to electrical terminals on the other side of the connector housing. The individual ground contacts are expensive to manufacture, additional terminals are required, and assembly of the bus in the connector housing is difficult.

In another arrangement, three rows of electrical terminals are disposed in a connector housing with the outer rows of terminals being terminated to respective signal conductors of two ribbon coax cables and the drain wires of the cables are terminated in respective electrical terminals on each side of the center row of electrical terminals in the form of ground terminations. This arrangement has resulted in several problems. One is the bus with its electrical terminals thereon is expensive to manufacture. Another is that terminating the ground conductors in the electrical terminals on each side of the bus is time-consuming and difficult owing to the small size of the conductors and electrical terminals.

SUMMARY OF THE INVENTION

According to the present invention, an electrical connector comprises a dielectric housing having rows of terminal passageways. First electrical terminals are respectively disposed in the passageways of one of the rows of terminal passageways for electrical termination with respective signal conductors of a flat cable. Second electrical terminals are respectively disposed in the passageways of another of the rows of terminal passageways and include electrical connection sections. A commoning connector member is adapted to be crimped onto the ground conductors of the flat cable, the crimped commoning connector member being connectable with the electrical connection sections.

DETAILED DESCRIPTION OF PREFERRED EMBODIMENTS

Figure 1:
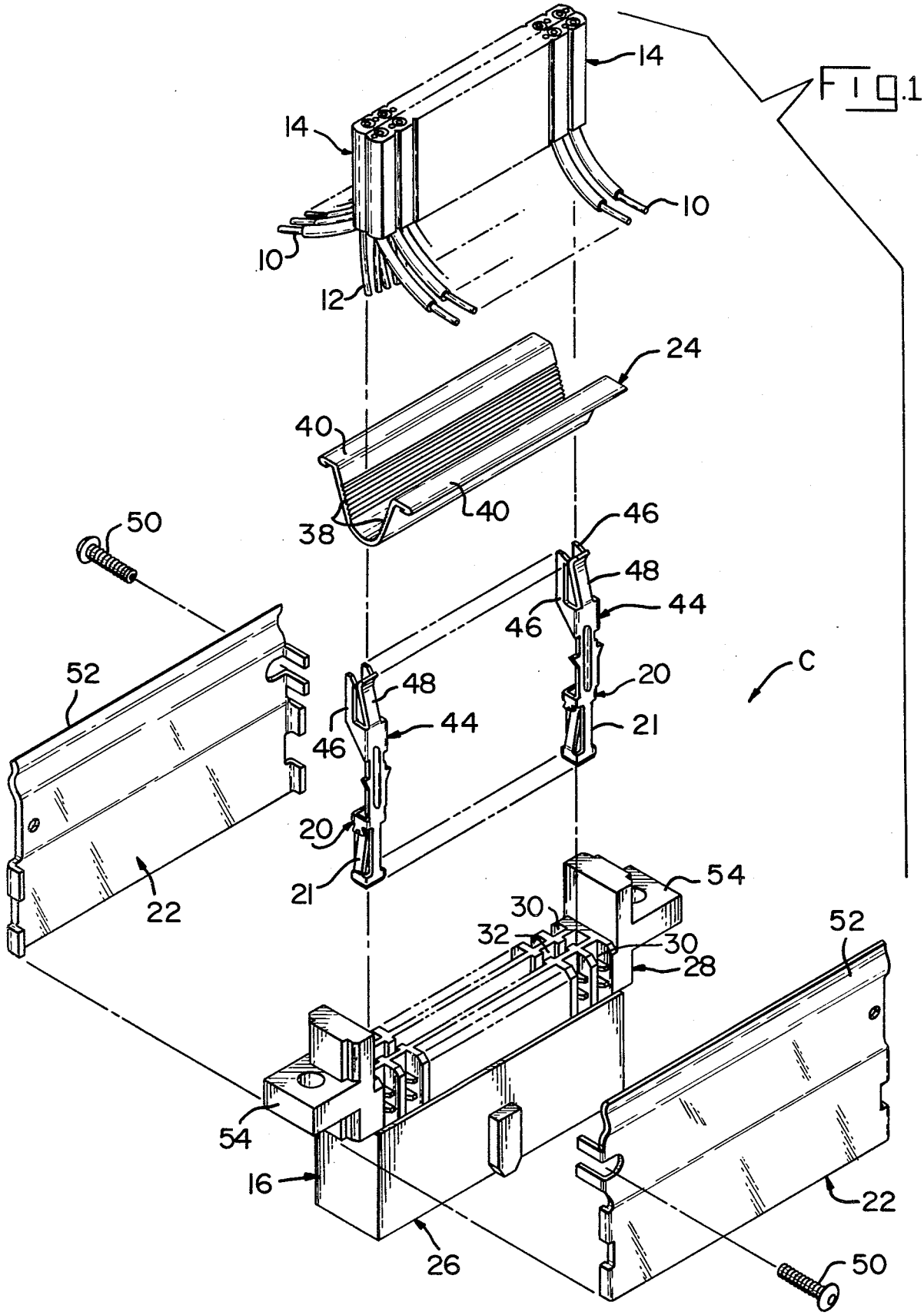
FIG. 1 is a perspective and exploded view of the electrical connector and a stripped end of a flat cable.
Figure 2:
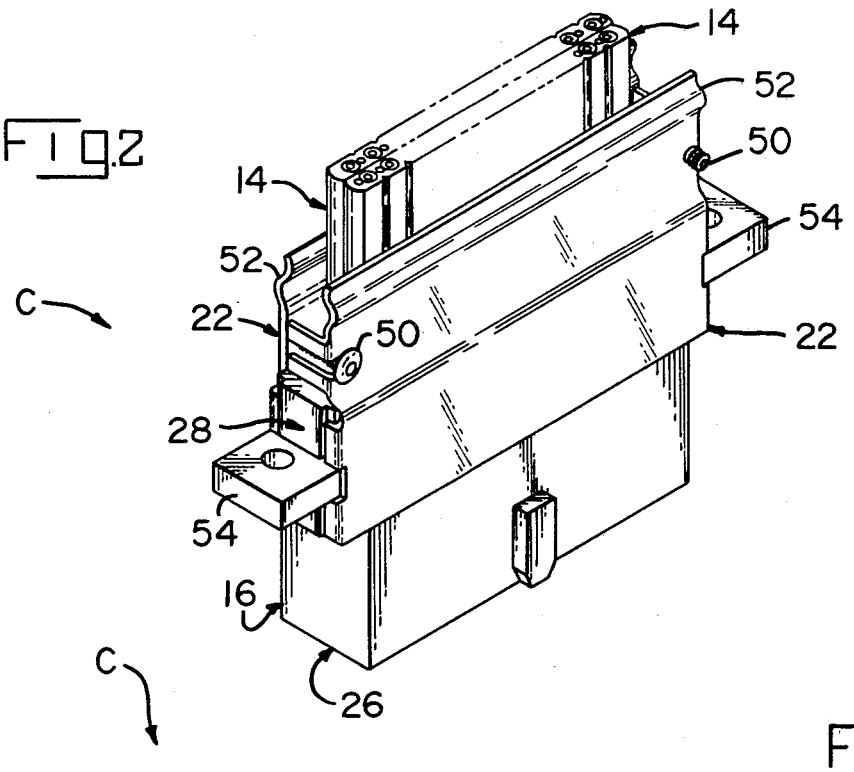
FIG. 2 is a perspective view of the connector terminated onto the cable.
Figure 3:
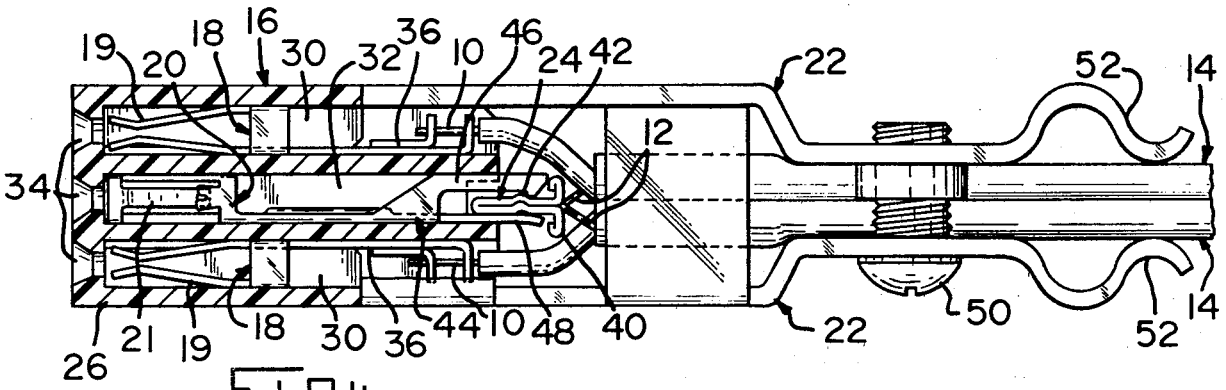
FIG. 3 is a cross-sectional view of FIG. 2.

FIGS. 1 through 3 illustrate the electrical connector C of the present invention which is terminated onto signal conductors 10 and ground or drain conductors 12 of ribbon coax cables 14 which are disclosed in U.S. Pat. No. 3,775,552. The ribbon coax cable is in the form of a flat cable.

Electrical connector C includes dielectric housing 16, electrical terminals 18, 20, cover and strain relief members 22, and commoning member 24.

Dielectric housing 16 is molded from a suitable plastic material and it includes a front section 26 and a rear section 28. Terminal passageways 30 are located along the sides of housing 16 within sections 26, 28 in which electrical terminals 18 are secured. Terminal passageways 32 are located between passageways 30, electrical terminals 20 being secured therein. Beveled openings 34 are located in the front of housing 16 in communication with respective passageways 30, 32. Thus, terminal passageways 30, 32 with electrical terminals 18, 20 respectively secured therein form rows of electrical terminals having receptacle sections 19, 21 respectively for electrical connection with respective posts on a printed circuit board (not shown) or electrical posts in a mateable electrical connector (not shown).

Electrical terminals 18 have conductor-terminating sections 36 in which signal conductors 10 are terminated as shown in FIG. 3.

Commoning member 24 is a V-shaped member having serrated areas 38 extending along the inside surfaces of the legs of the V-shaped commoning member 24. The ends 40 of commoning member 24 extend almost at right angles with respect to the respective legs from which they depend. Ground conductors 12 of cables 14 are positioned within commoning member 24 along serrated areas 38 and crimping members of a conventional crimping tool (not shown) move the legs of commoning member 24 into engagement with ground conductors 12 thereby mass-terminating ground conductors 12 therein. The final configuration of crimped commoning member 24 as shown in FIG. 3 has an arcuate section 42. Serrated areas 38, when crimped onto ground conductors 12, break down an oxide coating thereon thereby making an excellent electrical and mechanical termination thereto.

Receptacle sections 44 of electrical terminals 20 include hook-shaped members 46 facing spring members 48, the free ends of which are beveled outwardly.

After commoning member 24 has been terminated to ground conductors 12 of cables 14, terminated commoning member 24 is inserted into receptacle sections 44 of electrical terminals 20 in housing 16 and signal conductors 10 are terminated in the respective conductor-terminating sections 36 of electrical terminals 18 on each side of electrical terminals 20 as shown in FIG. 3. The termination of signal conductors 10 in conductor-terminating sections 36 is conducted in accordance with conventional terminating practices. Terminated commoning member 24 is maintained in receptacle sections 44 by hook-shaped members 46 engaging arcuate section 42 and spring members 48 biasing arcuate section 42 into engagement with hook-shaped members 46. The combination of the arcuate section 42 and the receptacle sections 44 form an excellent mechanical and electrical termination. The beveled ends of spring members 48 and the beveled leading edges of hook-shaped members 46 facilitate the insertion of terminated commoning member 24 within receptacle sections 44.

Cover and strain relief members 22 are secured onto housing 16 via screws 50 thereby being positioned onto section 28 of housing 16 and covering the terminations of signal conductors 10 in conductor-terminating sections 36, and strain relief sections 52 engage cables 14 to provide strain relief therefor. Lugs 54 extend outwardly from housing 16 to enable it to be mounted within an opening in a mounting panel if desired.

Figure 4:
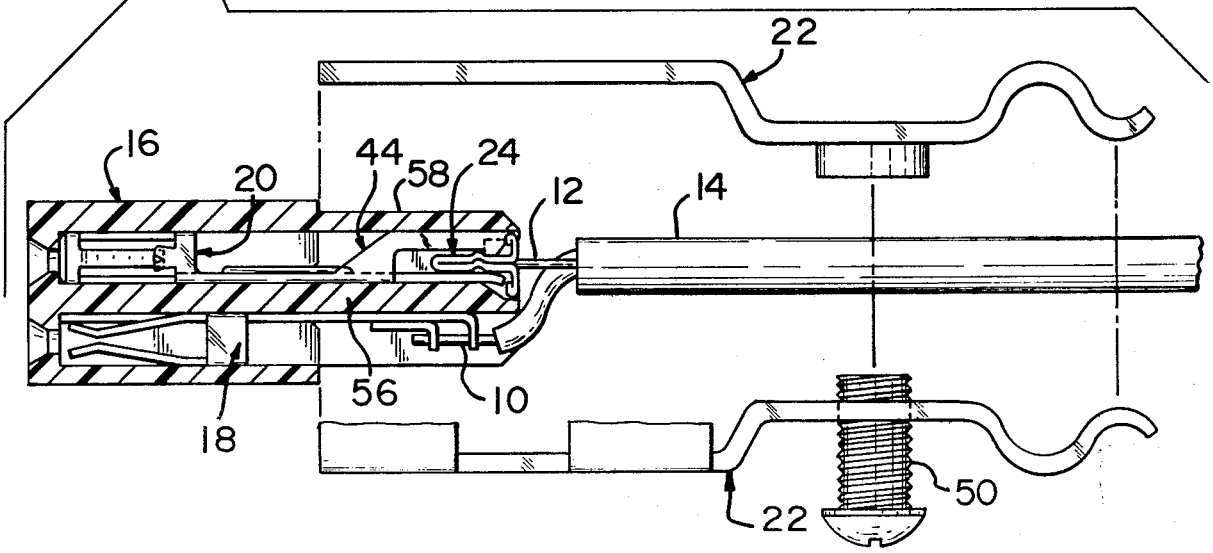
FIG. 4 is a cross-sectional view of an embodiment.

While housing 16 is shown in conjunction with being terminated with the signal conductors and ground conductors of two ribbon coax cables, housing 16 can be terminated to a single ribbon coax cable 14 as shown in FIG. 4 whereby signal conductors 10 are terminated to a single row of electrical terminals 18 and ground conductors 12 are terminated in commoning member 24 as hereinabove described. Otherwise the connector as illustrated in FIG. 4 is the same as that illustrated in FIGS. 1 through 3. In the event that the connector of FIG. 4 is to be used in conjunction with a flat transmission cable, separating member 56 of housing 16 covers one of ends 40 and wall 58 covers receptacle sections 44 including the other end 40 thereby preventing any shorting of the signal conductors with commoned ground conductors 12.

All of the pins on the printed circuit board connected to the ground planes which connect to electrical terminals 20 are now at the same potential to provide shielding or isolation.

I claim:

1. An electrical connector comprises a dielectric housing having rows of electrical terminals secured in passageways, conductor-terminating sections of one row of electrical terminals are to be terminated to respective signal conductors of a cable and connecting sections of the other row of electrical terminals are to be connected to ground conductors of the cable, characterized in that:

said connecting sections comprise receptacle sections in the form of substantially rigid members and opposing spring members;

a commoning member is terminatable onto the ground conductors thereby forming an elongated tab member electrically connectable between said rigid members and opposing spring members.

2. An electrical connector as set forth in claim 1 characterized in that said commoning member is V-shaped and has serrated areas in opposing surfaces.

3. An electrical connector as set forth in claim 2 characterized in that said V-shaped commoning member when terminated on the ground conductors has an arcuate section.

4. An electrical connector as set forth in claim 3 characterized in that the rigid members are hook-shaped members facing the opposing spring member with said arcuate section being biased against said hook-shaped members by said spring member.

5. An electrical connector as set forth in claim 4 characterized in that cover and strain relief members are secured onto said housing with cover sections covering the terminations and strain relief sections engaging the cable.

6. An electrical connector for terminating signal and ground conductors of cable means, comprising:

dielectric housing means having rows of terminal passageway means;

first electrical terminal means disposed in respective terminal passageway means of one of the rows of terminal passageway means for electrical termination with respective signal conductors;

second electrical terminal means disposed in respective terminal passageway means of the other of the rows of terminal passageway means, said second electrical terminal means having electrical connection means in the form of substantially rigid members and opposing spring members; and commoning member means adapted to be crimped onto the ground conductors thereby forming an elongated tab member electrically connectable between said rigid members and opposing spring members.

7. An electrical connector as set forth in claim 6 wherein said rigid members are hook-shaped members facing the opposing spring member.

8. An electrical connector as set forth in claim 7 wherein said commoning member means comprises a V-shaped member which when crimped onto the ground conductors has formed therein an arcuate section which is biased against said hook-shaped members by said spring member when said commoning member means is connected with said electrical connection means.

9. An electrical connector as set forth in claim 8 wherein said V-shaped member has opposing serrated sections.

10. An electrical connector as set forth in claim 8 and further comprising cover and strain relief means securable on said housing means and including cover sections for covering the electrical terminations of the signal conductors and strain relief sections for engaging the cable means.

* * * * *